US007584906B2

(12) United States Patent
Lev

(10) Patent No.: US 7,584,906 B2
(45) Date of Patent: Sep. 8, 2009

(54) FLUID DAMPENING MECHANISM INCORPORATED INTO A WATER DELIVERY SYSTEM FOR MODIFYING A FLOW PATTERN

(76) Inventor: Mordechai Lev, 6578 Torybrooke Cir., West Bloomfield, MI (US) 48323

( * ) Notice: Subject to any disclaimer, the term of this patent is extended or adjusted under 35 U.S.C. 154(b) by 463 days.

(21) Appl. No.: 11/296,111

(22) Filed: Dec. 7, 2005

(65) Prior Publication Data

US 2006/0144968 A1 Jul. 6, 2006

Related U.S. Application Data

(60) Provisional application No. 60/634,033, filed on Dec. 7, 2004.

(51) Int. Cl.
*B05B 3/16* (2006.01)

(52) U.S. Cl. ..... 239/382; 239/233; 239/240; 239/263; 239/381; 239/383; 239/222.15; 239/222.17

(58) Field of Classification Search ..... 239/237, 239/240, 263, 381–383, 548, 590, 590.5, 239/222.15, 222.13, 222.17, 222.21, 251, 239/233, 231

See application file for complete search history.

(56) References Cited

U.S. PATENT DOCUMENTS 3,713,587 A * 1/1973 Carson ..... 239/383
3,801,019 A 4/1974 Trenary et al.
3,861,503 A * 1/1975 Nash ..... 188/276
3,967,783 A 7/1976 Halsted et al.
4,101,075 A * 7/1978 Heitzman ..... 239/101
4,796,811 A * 1/1989 Davisson ..... 239/222.17
5,294,054 A * 3/1994 Benedict et al. ..... 239/222.15
5,397,064 A 3/1995 Heitzman
6,223,998 B1 5/2001 Heitzman
6,715,699 B1 4/2004 Greenberg et al.
2005/0045743 A1 3/2005 Chen
2005/0116063 A1 6/2005 Wang

* cited by examiner

*Primary Examiner*—Le Tran
*Assistant Examiner*—Jason J Boeckmann
(74) *Attorney, Agent, or Firm*—Gifford, Krass, Sprinkle, Anderson & Citkowski, P.C.

(57) ABSTRACT

An assembly for converting a fluid flow includes a housing having an inlet end for receiving the fluid flow and an outlet end for issuing a converted and output fluid flow. One or more rotatable components are supported within the housing, in a path contacting the inlet fluid flow. A selected component exhibits a plurality of arcuate and flow conducting surfaces, such as which are arranged about a circumference of the rotating component. A fluid dampening element is operatively connected to the rotating component and restricts a rotational speed associated with the rotatable component, in response to rotational forces imparted by the inlet fluid flow, and in order to modify at least one of a flow and pulse rate of the fluid.

8 Claims, 13 Drawing Sheets

FLUID DAMPENING MECHANISM INCORPORATED INTO A WATER DELIVERY SYSTEM FOR MODIFYING A FLOW PATTERN

CROSS REFERENCE TO RELATED APPLICATIONS

The present application claims the priority of U.S. Provisional Patent Application Ser. No. 60/634,033, filed Dec. 7, 2004, and entitled "Shower Head Assembly Incorporating a Rotating Swivel Within an Interior Deflectable Bell Housing".

BACKGROUND OF THE INVENTION

1. Field of the Invention

The present invention relates generally to shower head assemblies. More specifically, the present invention discloses a shower head assembly and faucet assembly incorporating a rotating, motion dampened, and water deflecting component. The rotating component provides for visually attractive fluid jet streams, massaging jet streams exhibiting alternating patterns and intensity, as well as an interlacing outer flow pattern in the instance of a sink faucet to reduce undesirable spray.

2. Description of the Prior Art

The prior art is well documented with varying types of showerhead or faucet assemblies. Common objectives of such assemblies include the creation of a water spray exhibiting a desired flow rate, pulse, direction and intensity for a given application.

A first example drawn from the prior art is set forth in U.S. Pat. No. 6,715,699, issued to Greenberg et al., and which teaches a showerhead engine assembly providing different combinations and variations of continuous, deflected, and/or adjustable pulsating sprays. In pulsating spray mode, the assembly includes a stator, spinner and engager. Additional components include a pressure plate and faceplate, openings being formed in both components to enable fluid flow therefrom. Of note, deflecting surfaces on the faceplate enable a variety of different flow patterns. The spinner is selectively activated, via the stator, to create vortex or pulsating spray patterns.

U.S. Patent Application Publication No. 2005/0116063, to Wang, teaches a sprayer device incorporating a rotary control member within its housing. The rotary member includes a number of cavities and outlets communicating with each other and which are selectively aligned with the front opening and the inlet of the housing to allow water to selectively flow through the housing. The housing further includes a mouth communicating with the inlet, to selectively align with either of the cavities of the rotary member, and to prevent the users from contacting with the water or chemical materials flowing out of the sprayer device.

U.S. Patent Application Publication No. 2005/0045743, to Chen, discloses a spraying head assembly for a massaging tub and including a housing, cover, water outlet valve seat, water outlet valve cover, vortex roller, bushing, nozzle, impulse rotor and motor. The water flow is pressurized by rotation of helically shaped blades associated with the vortex rotor, associated helical shaped plates of the water outlet valve seat producing a strong water beam that is injected outward from the nozzle, and in order to create the desired massaging effect.

U.S. Pat. No. 6,223,998, issued to Heitzman, teaches a shower head assembly including a housing enclosing a rotary valve member driven by a water activated motor. A rotatable tubular valve member surrounds the housing and has an internal cartridge with circumferentially spaced internal passages for selectively directing continuous flow water, cycling flow water directly to nozzle orifices, or cycling water to inner/outer sets of drive jets associated with a water pulsating turbine wheel. The spray discharge orifices may be adjusted by a control ring which cooperates with the valve member to provide for selecting various spray functions.

SUMMARY OF THE PRESENT INVENTION

The present invention discloses an assembly for converting a fluid inlet flow to an outlet flow pattern exhibiting any of a number of desired characteristics, including a specified flow velocity, dispersion pattern, and pulse rate. In particular, the present invention incorporates a rotatable, fluid dampening/regulated component for converting the input fluid flow to a regulated output pattern.

The assembly in each embodiment includes a housing having an inlet end for receiving the fluid flow and an outlet end for issuing a converted and output fluid flow. One or more rotatable components are supported within the housing, in a path contacting the inlet fluid flow.

A selected one of the rotatable components exhibits a plurality of arcuate and flow conducting surfaces, such as which are arranged about a circumference of the rotating component. The fluid dampening element is operatively connected to the rotating component, such including an oil or other viscous fluid based reservoir in communicating fashion with the rotating component, and restricts a rotational speed associated with the rotatable component in response to the rotational forces imparted by the inlet fluid flow, this in order to modify at least one of a flow and pulse rate of the fluid. The illustrated embodiments of the present assembly include applications as a shower head or a faucet, it being understood that other and additional variants and applications are possible within the ordinary skill of one in the relevant art.

BRIEF DESCRIPTION OF THE DRAWINGS

Reference will now be made to the attached drawings, when read in combination with the following detailed description, wherein like reference numerals refer to like parts throughout the several views, and in which.

DESCRIPTION OF THE PREFERRED EMBODIMENTS

Figure 1:
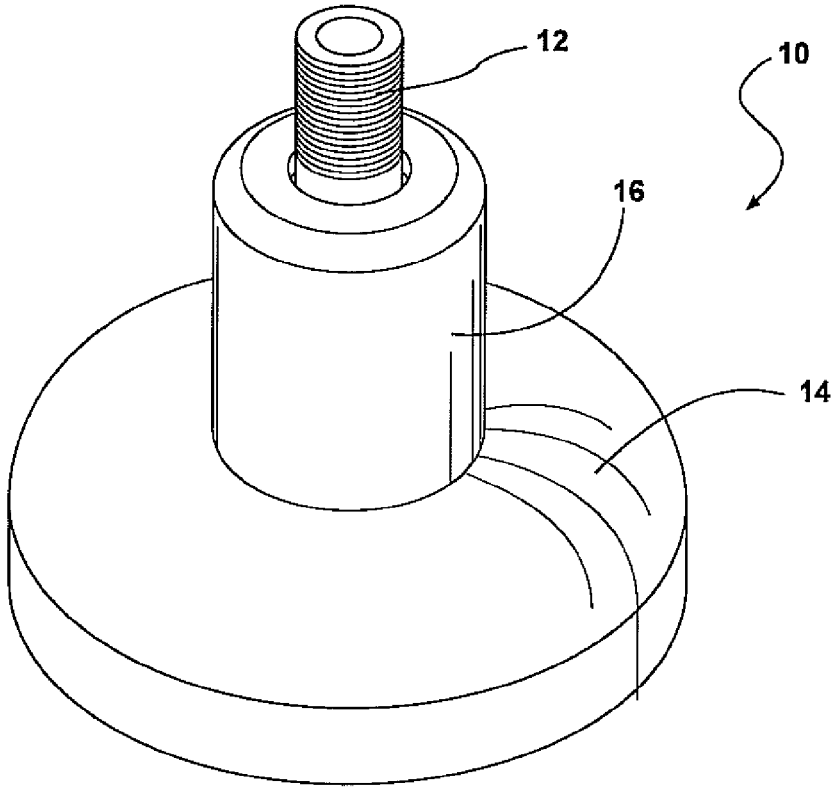
FIG. 1 is a perspective view of a perspective illustration of a shower head assembly according to a preferred embodiment of the present invention.

Referring now to FIG. 1, as well as each of the succeeding views of FIGS. 2-5, a series of illustrations are shown at 10 of a shower head assembly according to a first preferred embodiment of the present invention. As will be described in further detail throughout the following embodiments, the present invention discloses a shower head assembly incorporating fluid dampening characteristics.

In cooperation with a specific geometry associated with the components making up the assembly, the dampening mechanism facilitates a simplified and improved device for controlling an issued outlet flow pattern, rate of flow and direction, these in response to any range of inlet pressure flow. An advantage of the invention is the ability to provide consistent fluid flow output characteristics regardless of a wide range of inlet fluid pressures, this consistent with maintaining lower speeds of rotation associated with the rotating components of the shower assembly, and than would occur in the instance of a non-regulated dampening mechanism.

Referring again to FIG. 1, a perspective view is illustrated generally at 10 of a perspective illustration of a shower head assembly according to a preferred embodiment of the present invention. As will be described in detail, the shower head assembly 10 according to this variant is particularly designed to create a somewhat slower rate of water pulsation, and as compared to overly fast and closely spaced water jet pulses attendant with prior art shower head designs, these further tending to generate an overall feel of impact, but without generating any significant massage effect.

Figure 2:
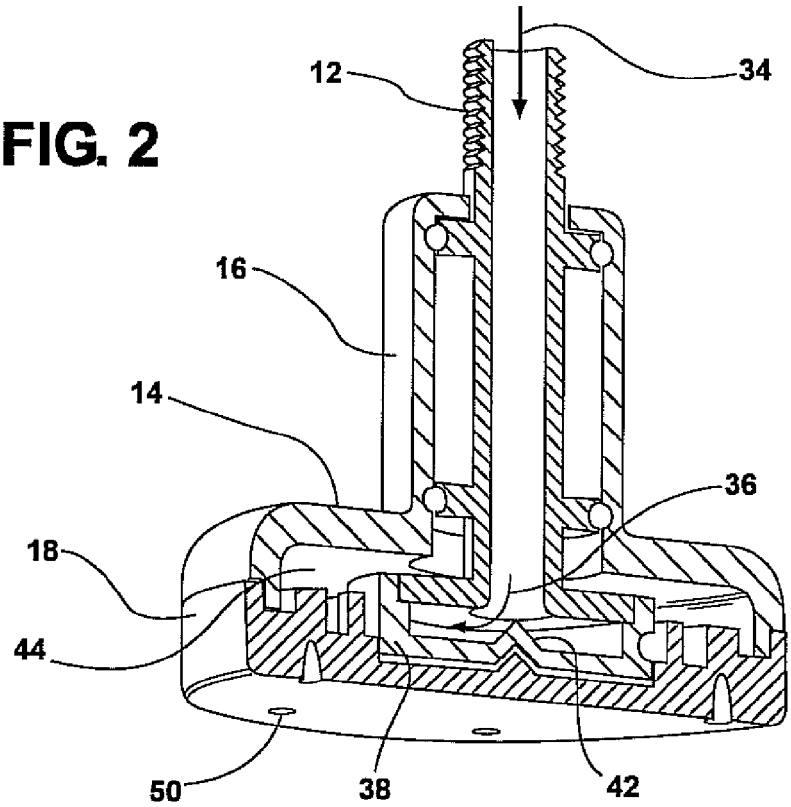
FIG. 2 is a cutaway view of the shower head assembly of FIG. 1 and illustrating its inner components, including stationary main shaft with water jet distributing chamber, as well as outer rotatable plate cover and attachable nozzle plate.

Features of the design, as also referenced in FIG. 2, include an elongated main shaft 12, through a threaded inlet of which is provided water, as well as an outer, annular shaped, and rotatable cover 14 extending upwardly from which is a collar portion 16 which surrounds the main shaft 12. As will be discussed in further detail in the succeeding illustrations, a rotatable nozzle plate 18 is secured to the cover 14 and, in cooperation, defines a rotating outer component secured about the stationary main shaft 12.

Figure 3:
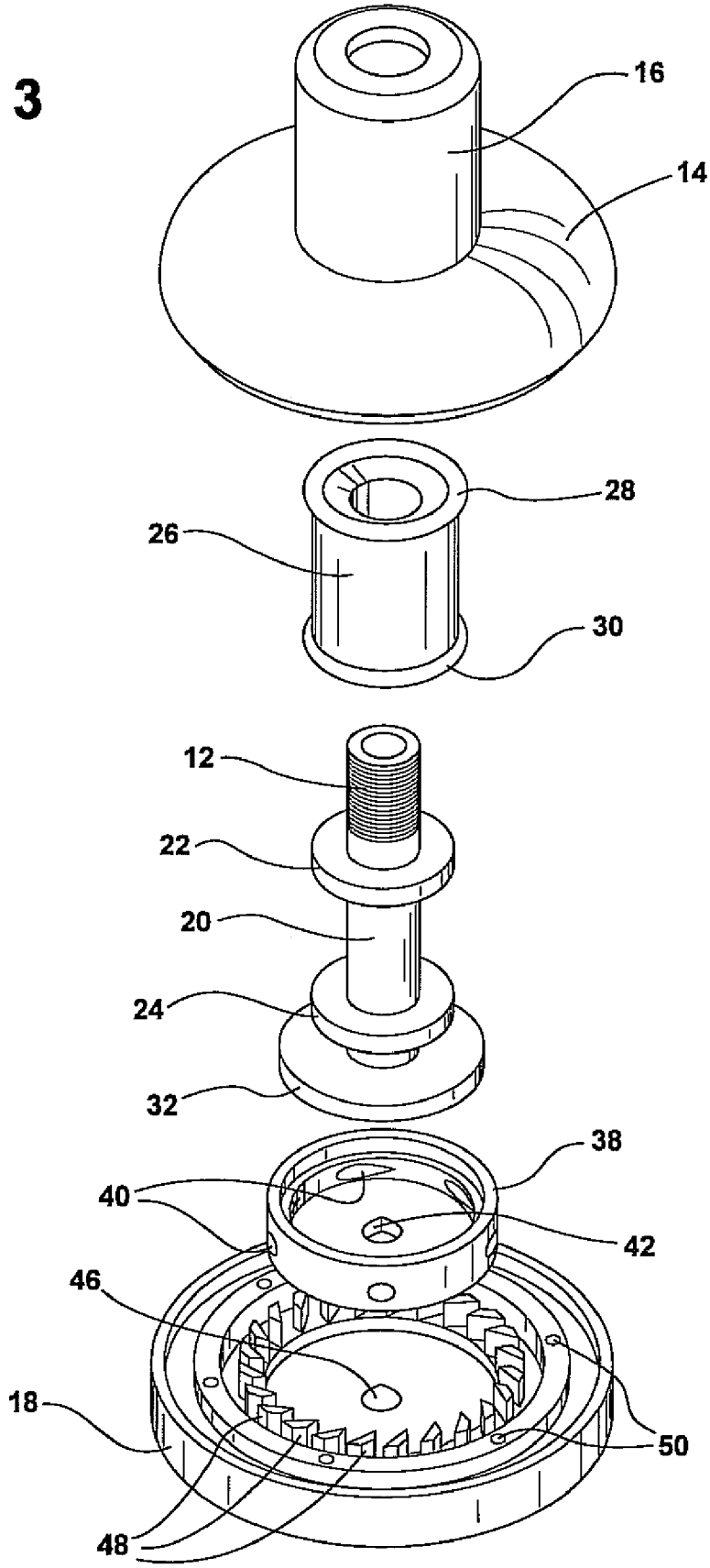
FIG. 3 is an exploded view of the shower head assembly of FIG. 1.
Figure 4:
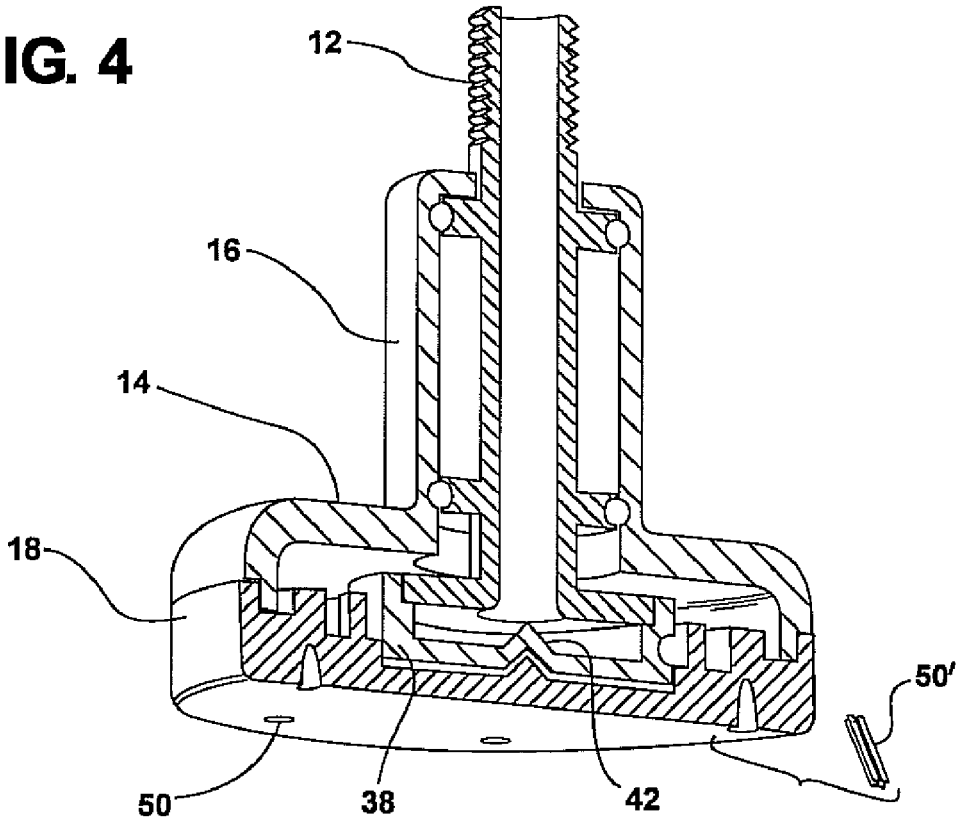
FIG. 4 is a further cutaway view, similar to that shown in FIG. 2, and illustrating in additional detail the features of the water jet distributing chambers and rotating nozzle plate.

As further illustrated by the exploded view of FIG. 3, the inner working components of the shower head assembly are shown and include a more complete illustration of the main shaft 12, this further illustrating an interior stem portion 20 bounded by first and second axially spaced collars 22 and 24, between which is supported a fluid dampening (oil) reservoir 26 through the further assistance of a pair of upper 28 and lower 30 O-rings which seal the fluid reservoir 26 between the main shaft supported collars 22 and 24.

The shaft 12 terminates at a bottom end in a further enlarged annular collar 32 and such that an interior fluid flow delivered through the interior of the main shaft 12, see at 34 in FIG. 2, exits beneath the collar 32 see further at 36 in FIG. 2.

FIG. 2 again further illustrates a cutaway view of the shower head assembly of FIG. 1, and which includes a water jet distributing chamber, see annular and 3D disk shaped element 38 upon which is seated the annular edges of the collar 32, these defining therebetween an interior chamber surrounding the fluid location 36 referenced in FIG. 2. A plurality of angled water jet apertures are further illustrated at 40 (see also FIG. 3), defined in circumferentially offset and angled fashion about the disk shaped element 38. To assist in fluid dispersion, a central and conical shaped projection is positioned at 42 upon the upper interior surface of the disk shaped element 38 and in order to assist in equidistant and outer deflection of the fluid 36 collected within the water jet chamber.

The nozzle plate 18 is further configured so that it sandwichingly engages the water jet chamber (stem supported collar 32 and 3D disk element 38) upon the nozzle plate 18 being secured against the cover 14. An outer and annular shaped open interior compartment, see at 44, is further defined between the rotating nozzle plate 18 and cover 14 as illustrated in FIG. 2 and, as will be further described, is designed to assist in pulsed distribution of water flow from the assembly.

Figure 5:
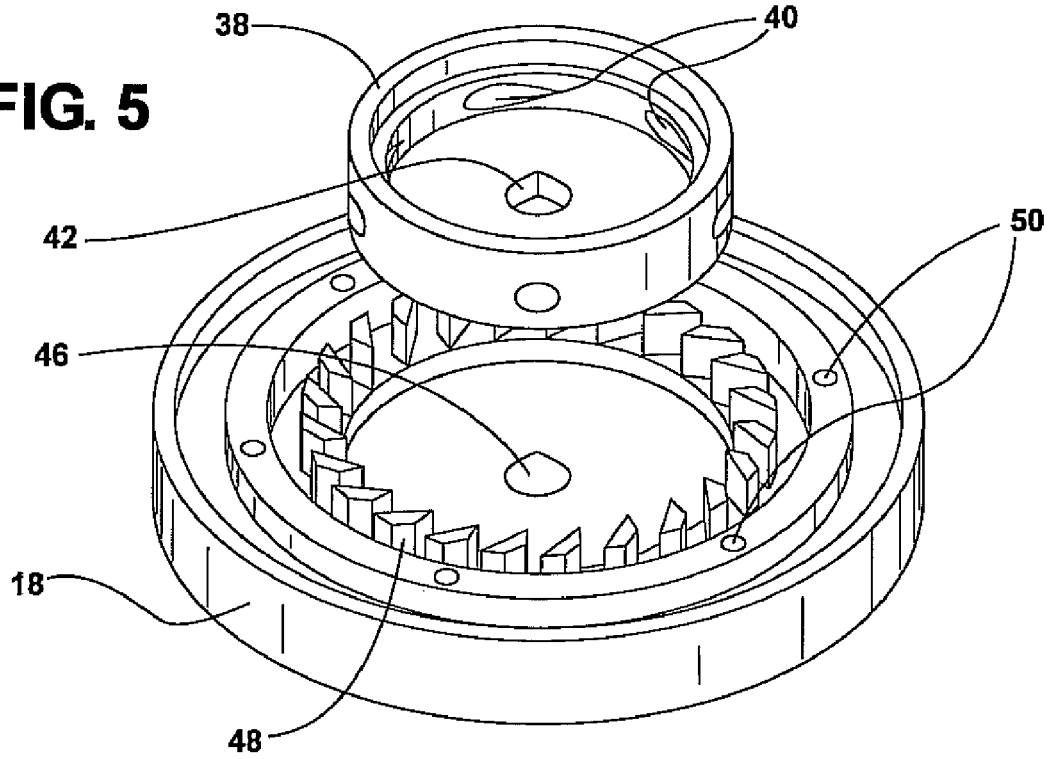
FIG. 5 is a sectional exploded view of the features of the main shaft's lower water jet chamber and rotary propelled nozzle plate.

As best shown in the enlarged and sectional exploded view of FIG. 5, the nozzle plate 18 further includes a raised projection 46 defined upon a central location of its inner base surface, upon which is supported the rotatable water jet chamber (or 3D disk element 38). Also defined in circumferential fashion around an intermediate interior of the nozzle plate base surface is a plurality of angled propelling blade portions 48, see at best shown in FIGS. 3 and 5.

The propelling blade portions 48 typically define an integral part of the rotating nozzle plate 18, it being further understood that the portions 48 could be redesigned as a separate part, such as supported upon a separate disk, and which may exhibit some relative movement to the nozzle plate 18.

Further communicating the outer annular interior compartment 44, to which the outwardly propelled and redirected water is centrifugally forced to the bottom exterior of the rotating nozzle plate 18, are a plurality of individual and downwardly angled nozzles 50. Although illustrating individual nozzles 50 about the periphery of the nozzle plate 18, it is also understood that each nozzle could be substituted by subset pluralities of nozzles (such as four apiece and as further indicated at 50' in FIG. 4), or that any other dispersal of outlet nozzles 50 can be provided at any location or angle/arcuate pattern of direction relative to the bottom face of the nozzle plate 18.

In operation, a flow of water is supplied to the assembly through the upper inlet end of the main shaft 12 (and such as which may be further threadably connected to a suitable pipe or other fluid delivery conduit). The main shaft 12 and water jet chamber (i.e., shaft supported collar 32 and assembled 3D disk element 38) define a sealed chamber, through which the pressurized fluid is dispersed by the outwardly and radially/angularly directed jet holes 40. As best illustrated in FIG. 5, the jet holes 40 are angled in a substantially perpendicular fashion relative to a radius defined by the 3D disk element 38, however may be angularly adjusted in more than one axis.

The fluid thus dispersed then impinges upon the circumferential array of propelling blades 48, at which point the water, upon being collected about the outer annular chamber 44 of the rotating nozzle plate 18, achieves a lower degree of pressurization during which it is communicated out through the individually angled or sub-pluralities of angled nozzles 50.

According to the embodiment illustrated, the nozzle plate 18 and associated cover 14 rotate as a result of the water jet interaction with the circumferential array of rotary propelling blades 48. The rotation speed of the assembly is however reduced according to the dampening features provided by the oil reservoir 26 (further dependent upon the viscosity exhibited by the chosen reservoir fluid) and as applied between the shaft 12 and rotating cover 14.

It is further contemplated that the fluid distribution nozzles 50 may either be arranged parallel or angled relative to the axial direction exhibited by the main shaft 12, this adjusting the appearance and feel of the spray issued therefrom. It is further understood that the dimensions (e.g. height, inner diameter or outer diameter) of the fluid dampening chamber 26 (reservoir) can be adjusted to modify the rotation speed of the assembly, thereby accomplishing a variable speed shower mechanism.

It is also understood that the nozzle design (e.g. 50 or 50') can incorporate any suitable focusing or redirecting component for further modulating the downward generated fluid patterns, according to any of flow velocity, pulse rate or the like. The water flow patterns issued through the angled or arcuately configured nozzles 50 may also exhibit a tangentially induced pressure, again depending upon the variables of the dampening fluid viscosity or geometry characteristics of the assembly.

Figure 6:
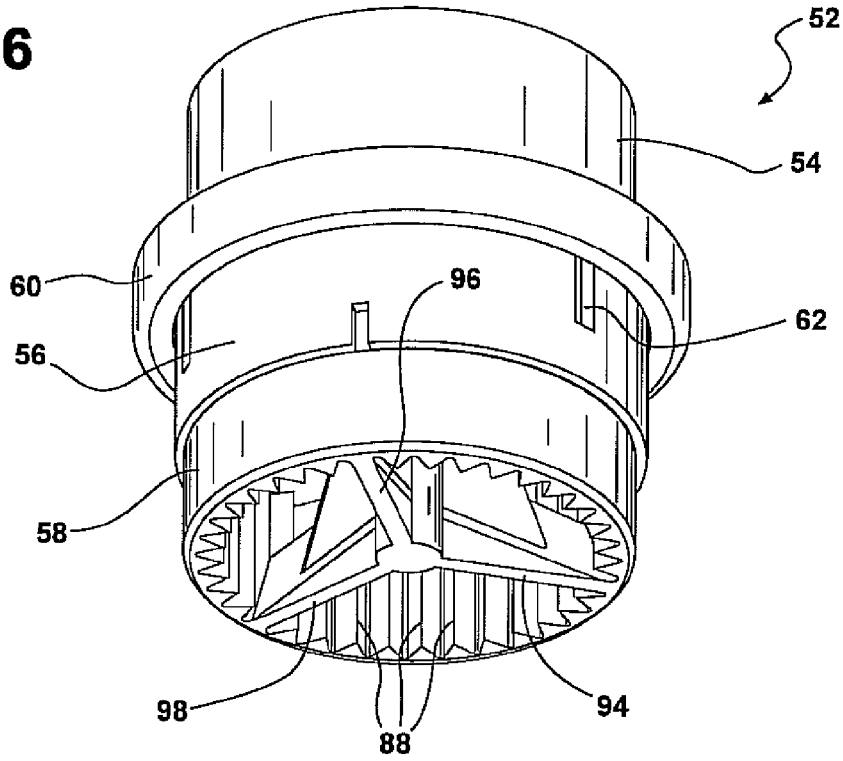
FIG. 6 is a perspective illustration of a shower head assembly according to a further preferred embodiment of the present invention.
Figure 8:
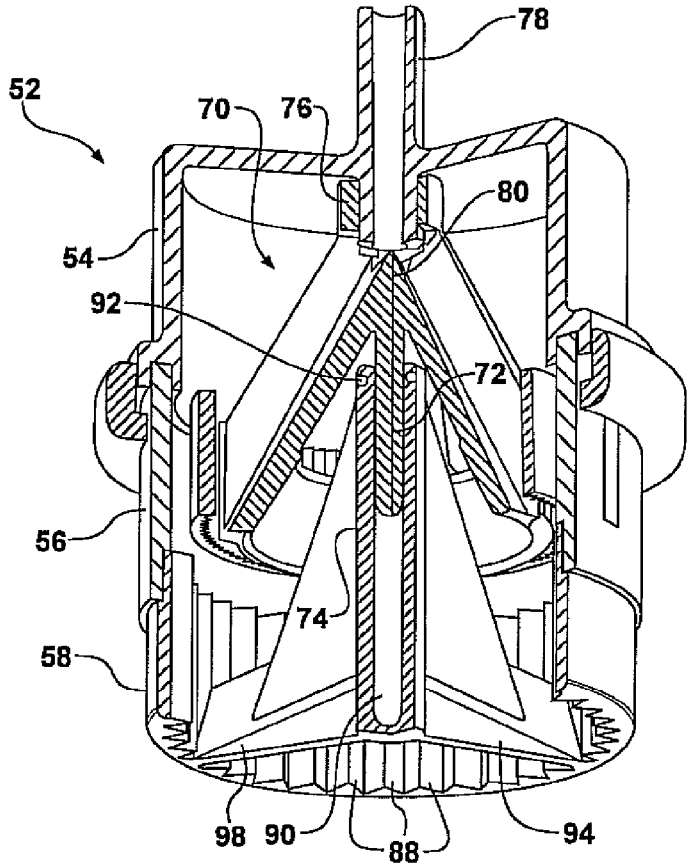
FIG. 8 is a cutaway perspective illustration of the shower head assembly of FIG. 6 and illustrating the manner in which water flow is dispersed.
Figure 7:
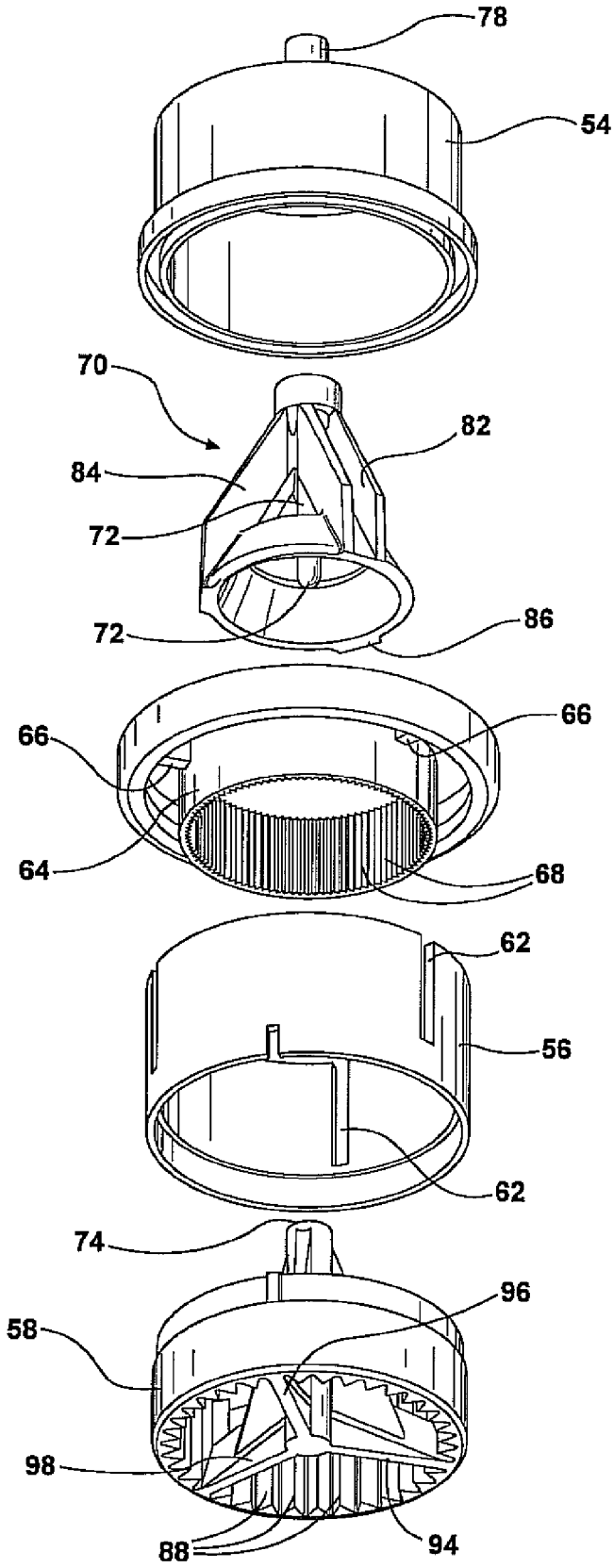
FIG. 7 is an exploded view of the shower head assembly of FIG. 6 and illustrating the features of the rotating swivel and axially displaceable and slot shaped housing supported sliding ring disposed between a stationary top and bottom deflector.

Referring now to FIGS. 6-8, respective perspective, exploded and cutaway illustrations are shown, at 52, of a shower head assembly according to a further preferred embodiment of the present invention. The variant 52, as will be further described, provides a variable speed shower mechanism for issuing a fine mist spray.

Stationary components defining an outer housing of the assembly 52 include an assembleable top 54, outer annular housing 56 and bottom deflector 58, and such as exhibits a plurality of grooved inner surfaces as shown. A sliding ring component 60 is mounted in axially displaceable fashion within slots 62 defined in the annular housing 56, and further such that a central circular portion 64 is interconnected to the outer ring 60 via radial stem portions 66 which fit into the respective slots 62 (see again FIG. 7). As again is best shown in FIG. 7, an inner annular facing surface of the central circular portion 64 further exhibits a plurality of fine vertically extending grooves 68.

A variably rotatable swivel 70 (see also progressively rotated perspective views of FIGS. 9 and 9*a*) is supported within the central circular portion 64, upon assembly, and such that a central shaft 72 is supported within a collar 74 defined in the deflector 58 at a lower end. See also upper end collar 76 (FIG. 8) which rotatably supports the swivel 70 to water inlet tube 78.

As further illustrated in FIG. 8, a cutaway perspective illustrates the shower head assembly of FIG. 6 and in particular the manner in which water flow is dispersed. In this illustration, water is supplied to the mechanism through the top disposed water inlet tube 78 extending through the top 54 of the assembly.

At this point, the water flows to the interiorly mounted and rotatable swivel member 70, i.e., upon a cone shaped projection 80 (see again FIG. 8) defined at a central receiving upper end of the swivel 70 located underneath the water inlet tube 78, and whereupon the inlet water flow separates into three individual channels (see for example at 82, 84 and 86) without splashing and in order to generate three corresponding water jets. The cross section of the three channels in the swivel 70 are such that they flatten the water jets upon exiting the channels.

Figure 9:
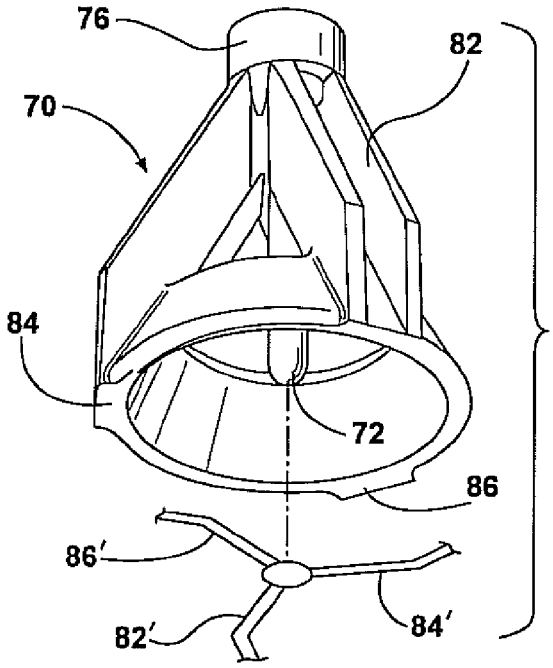
FIGS. 9 and 9*a* are progressively rotated sectional perspectives of the swivel component in the embodiment of FIG. 6.
Figure 9A:
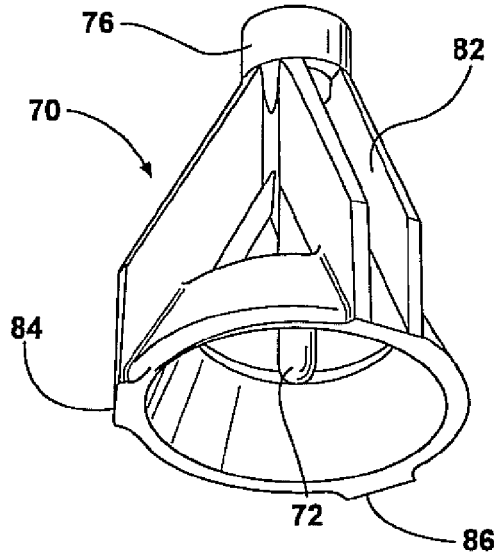

As further evidenced in the sectional perspective of the swivel 70 in FIG. 9, a rotated plan illustration of the water jets, shown at 82', 84' and 86' respectively, illustrates the angled manner in which the jet passageways may adapt in extending fashion from its top to outwardly flared bottom ends. In this fashion, the configuration of the passageways is such that it facilitates an appropriate tangential or swirl pattern to the eventually distributed water spray, it being understood that an otherwise linear extending jet passageway may result only in an undisciplined outward spray of fluid jets, and without any significant tangential or pressurized effect.

The water jets exiting passageways 82, 84 and 86 then impact the sliding ring component 60, causing the same to axially slide up and down relative to the bottom positioned deflector 58 on a user selected basis. When the sliding ring 60 is disposed in a first upper position relative to the swivel 70, the three jets issuing therefrom impact the deflector 58 to establish a coarse spray, and by impacting the coarse grooves 88 arrayed about the inside circumference of the lower deflector 58. Upon repositioning the sliding ring 60 in a second lower position, the impacting fluid jets 82, 84 and 86 separate into multiple fine sprays, further resulting from their outward/downward angle of impact against the fine grooves 68 (as opposed to the coarse grooves 88 of the lower deflector 58).

In either position, the swivel 70 (the only rotating component in this assembly) is caused to rotate more slowly due largely to the oil-dampening reservoir 90 (see FIG. 8) established between the swivel lower extending shaft 72 and the central receiving chamber 74 of deflector 58. This construction serves to provide a specified degree of resistance dependent upon the amount of downward force applied against the rotating swivel 70 by the introduced water jet streams and the vertical position of the sliding ring 60 within the slotted housing 56. A single upper O-ring 92 (see again FIG. 8) encloses the fluid dampening reservoir 90, the lower end of the reservoir defining in combination an enclosed volume holding cavity.

As is also known, the height, inner diameter or outer diameter of the oil chamber 90 and swivel shaft 72 define the degree of dampening provided, as well as the viscosity exhibited by the selected fluid. These parameters can be modified, either singularly or in combination, and in order to change such as the rotation speed of the swivel and in order to provide the desired variable speed effect and dispersion of the water sprays issued through the bottom openings defined in the deflector 58. As is also illustrated, a supported bridge of three members 94, 96 and 98 supports the central receiving chamber 74 of the lower deflector 58 in a minimally affecting fashion relative to the outlet spray flow issued from the swivel 70.

Figure 10:
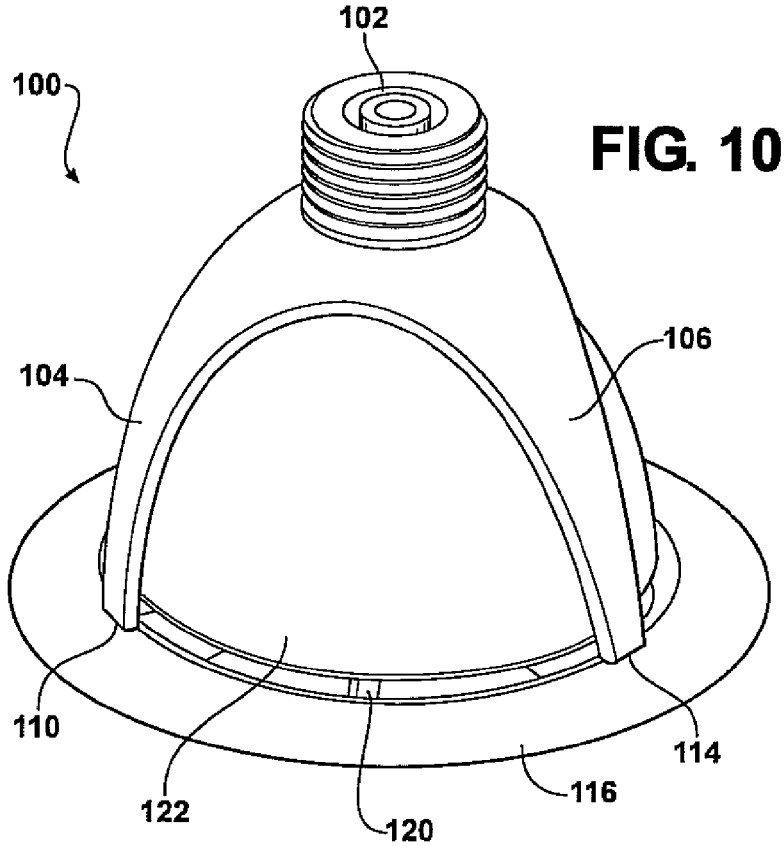
FIG. 10 is an assembled view of a shower head assembly according to a yet further preferred embodiment of the present invention.

Referring now to FIG. 10, an assembled view of a shower head assembly is illustrated at 100 according to a yet further preferred embodiment of the present invention. In particular, the assembly 100 is a reversal to that illustrated at 52 in FIG. 6, in that the lower positioned deflector now defines the rotating part, and as opposed to being fixed.

Figure 11:
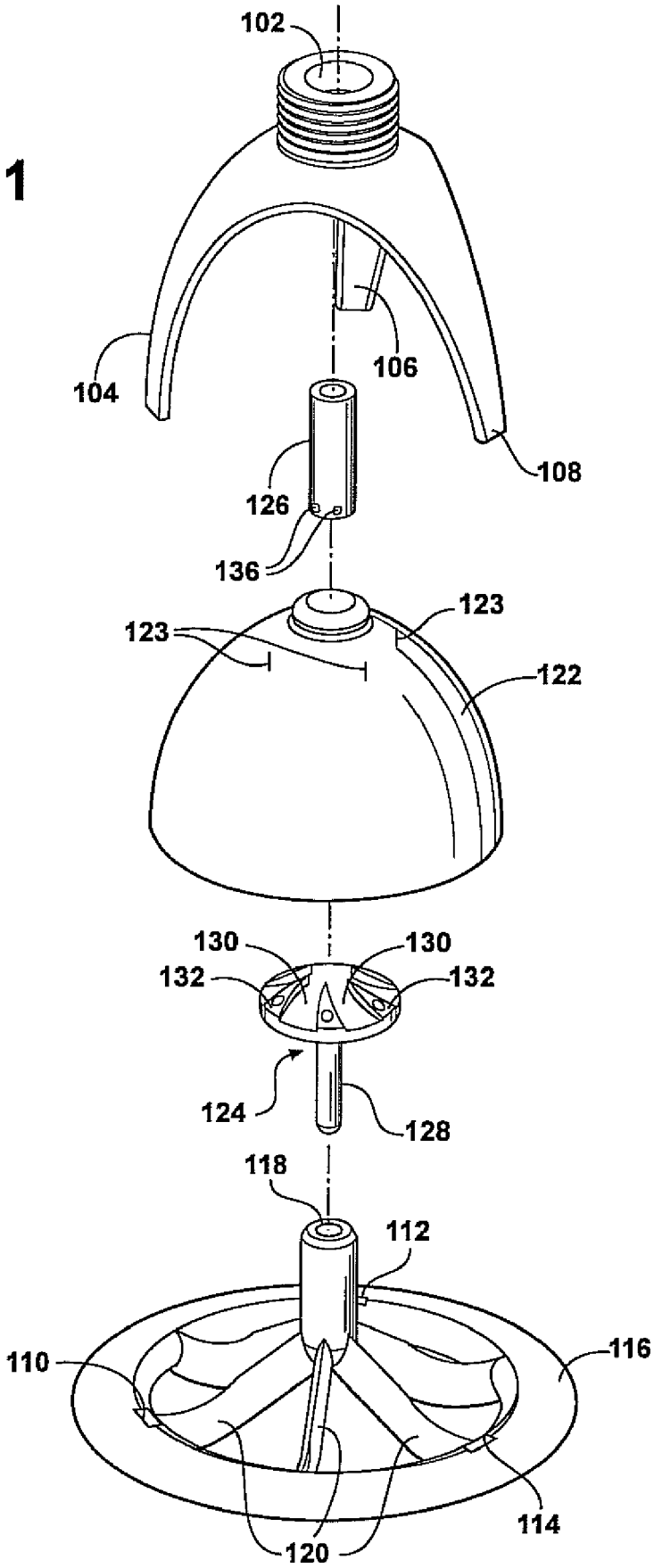
FIG. 11 is an exploded view of the shower head assembly of FIG. 10 and illustrating the features of the rotatably supported deflector and inner supported fluid dispersion cone.

Referring also to the exploded view of FIG. 11, an upper tripod shaped body (stationary) includes a threaded and fluid receiving upper end 102 from which extend in downward arcuate fashion three downward legs 104, 106 and 108. The legs secure at bottom ends to respective locations 110, 112 and 114 corresponding to a stationary bridge 116. The bridge further includes a central and upwardly extending inner channel 118, supported by a plurality of radially directed stem supports 120.

Centrally disposed and rotating components of the assembly 100 include an inverted bowl-shaped deflector 122, as well as a rigidly mounted and concurrently rotating cone 124. Pins 123 are illustrated inside deflector 122 and which mount to recessed locations of the cone 124 to position it proximate the top inner location of the deflector 122.

As again best shown in FIG. 11, a nozzle 126 both supports at an upper end as well as communicates fluid flow with the interior of the deflector 122, the cone and deflector being rotatably supported at a likewise lower end by a stem 128 which extends downwardly from the integral cone surface and which is rotatably seated within the upwardly extending inner channel 118. As with previous embodiments, the provision of an oil chamber, oil and seal (not evident) may also be provided at the interface between the stem 128 and inner receiving channel 118 and in the manner previously described.

Figure 12:
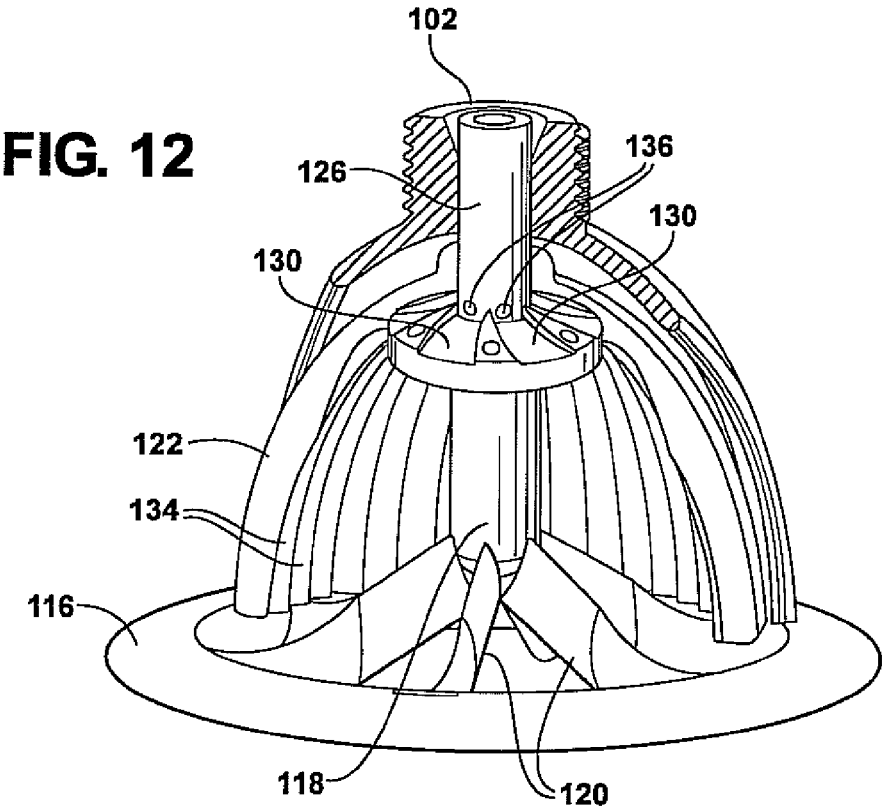
FIGS. 12 and 12*a* are progressively rotated sectional cutaways of shower head assembly of FIG. 10.
Figure 12A:
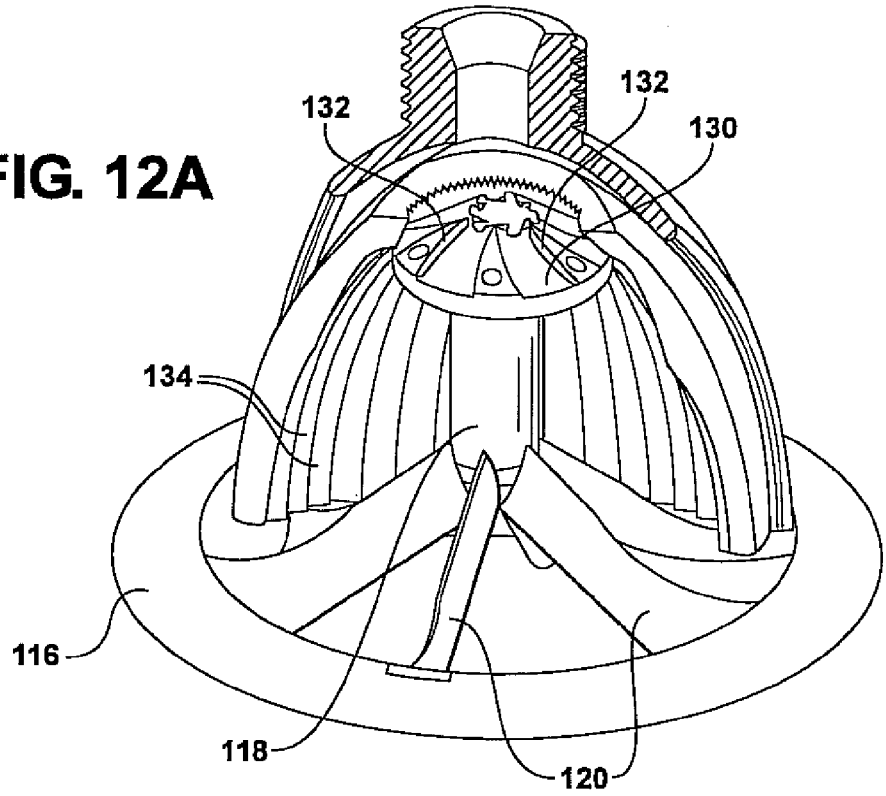

As further illustrated in FIGS. 12 and 12*a*, an enlarged and sectional cutaway of shower head assembly shows features of the cone shaped rotating dispersion element 124, such including radially and arcuately extending channels 130. Also referenced at 132 (see FIG. 12*a*) are the arcuate and radial trajectories of the shoulder portions, these defining therebetween the channels 130 and which assist in delivering an increased spinning force to the water flow patterns.

Figure 13:
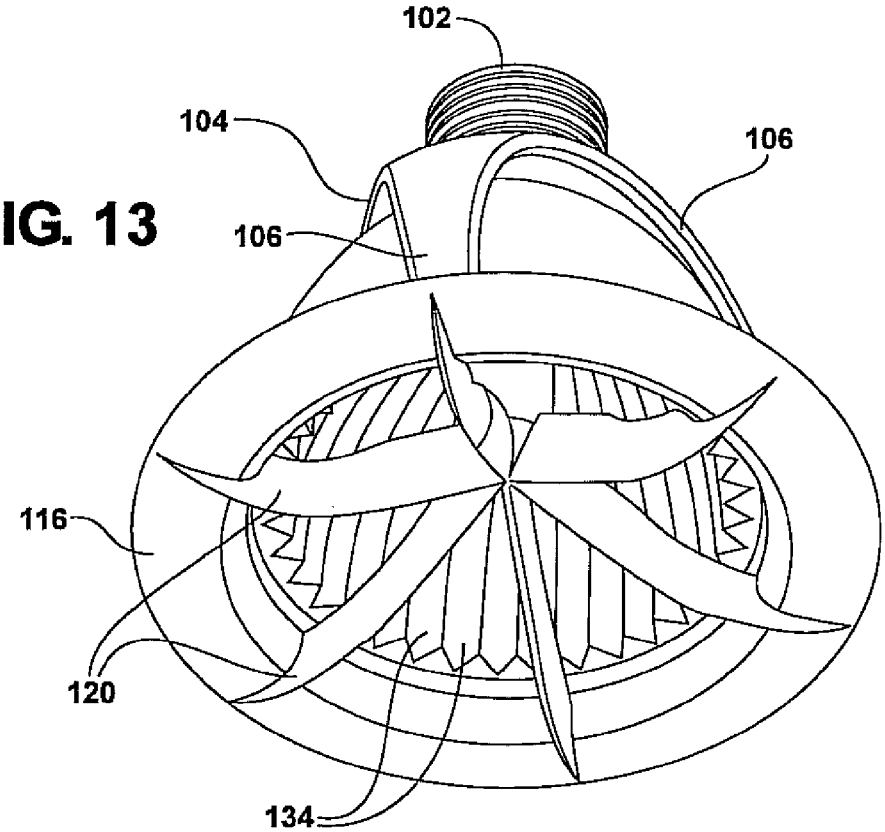
FIG. 13 is an underside perspective of the shower head assembly of FIG. 10 and illustrating the configuration of the inner and downwardly disposed outlet grooves associated with the bell shaped rotating deflector.

Further shown in FIG. 13 is an underside perspective of the shower head assembly of FIG. 10, and illustrating the configuration of the inner and downwardly disposed outlet grooves, see at 134, associated with the bell shaped rotating deflector 122. The individual inner bell grooves 134, while not clearly shown, are understood to include non-conformingly extending passageways, extending between their upper joining ends in communication with the upper mounted cone 124, to their lower and outwardly flared ends. It is also understood that the configuration of the passageways 130 (made possible by the arcuate shoulder configurations 132) of the rigidly mounted cone is similar to that of the inner bell grooves 134.

As referenced by the cutaway of FIG. 12, the interface between the stationary inner nozzle 126 and rotating deflector 122 and interior supported and rotating fluid dispersing cone 124 is again shown. In particular, the nozzle 126 seats over a pointed upper center of the cone 124 and exhibits side apertures 136, these located interior to the top end of the deflector and proximate the upper arcuate surfaces of the rigidly mounted and likewise spinning cone.

High speed rotation of the assembly results in the individual jets of fluid dispersed from the stationary nozzle 126, through the arcuately and outwardly directed pathway apertures 136 formed through the nozzle as indicated. Upon being arcuately and outwardly deflected by the high speed rotating cone 124, the individual jets of water, i.e. at 130, are downwardly conveyed along the inner facing outlet grooves 134 extending downwardly within the bell shaped deflector 122, and prior to being issued as a fine and equally distributed mist about the perimeter of the downwardly facing deflector.

The rotated perspective of FIG. 12*a*, with removal of the upper stationary nozzle 126, further illustrates the particular geometry associated with the cone arcuate surfaces 130 and shoulder 132 and which, in matching configuration with the inner deflector grooves 134, facilitate in the creation of the desired flow patterns. In this fashion, and upon an experienced fluid inlet pressure flow through threaded end 102, the deflector 122 and inner cone 124, the effect of the viscous oil dampening reservoir is causes the cone 124 and associated deflector 122 to rotate more slowly than it otherwise would, this in turn affecting the pressure and flow patterns of the downwardly and deflecting created spray.

Figure 14:
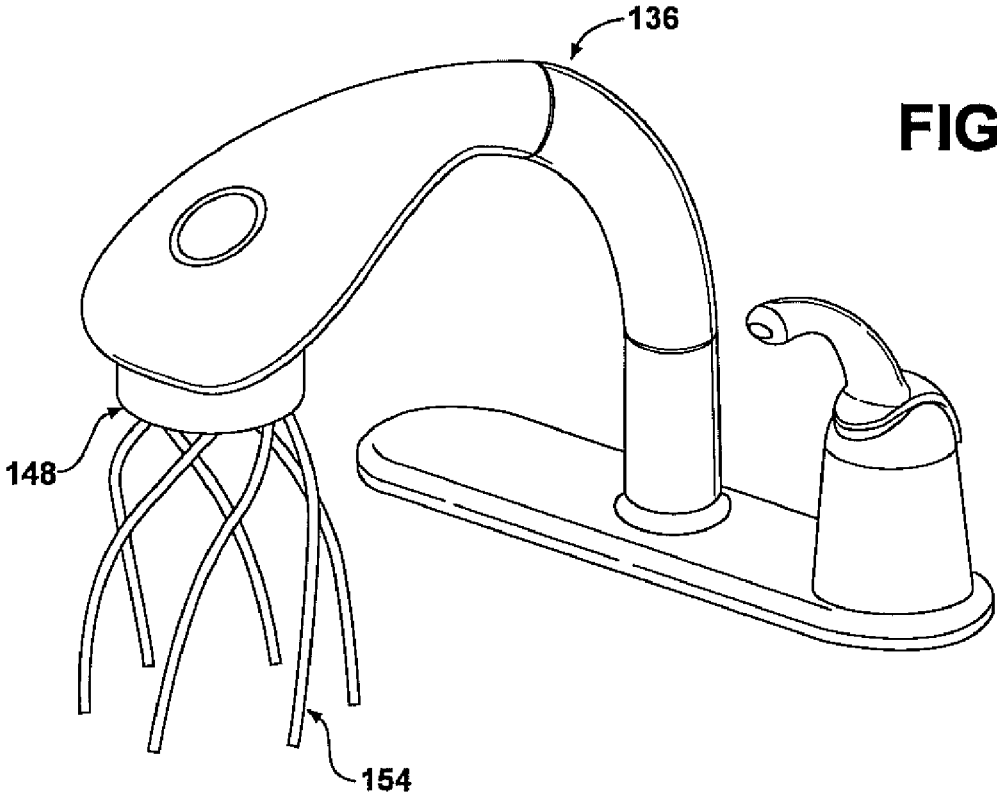
FIG. 14 is a perspective illustration of a faucet assembly according to a further preferred embodiment and incorporating a latticework of interlacing fluid streams which cooperate to create an enveloping outer curtain of a distributed water flow and in order to maximize the generation of fluid cleaning pulses, as well as preventing undesirable splash and spray.

Referring now to FIG. 14, illustrated at 136 is a faucet assembly incorporating the concept of the present invention. In particular, the variant of FIG. 14 discloses the creation of an intertwining latticework of fluid streams, these cooperating to create an enveloping outer curtain of a distributed water flow and in order to maximize the generation of fluid cleaning pulses, as well as preventing undesirable splash and spray.

Figure 17:
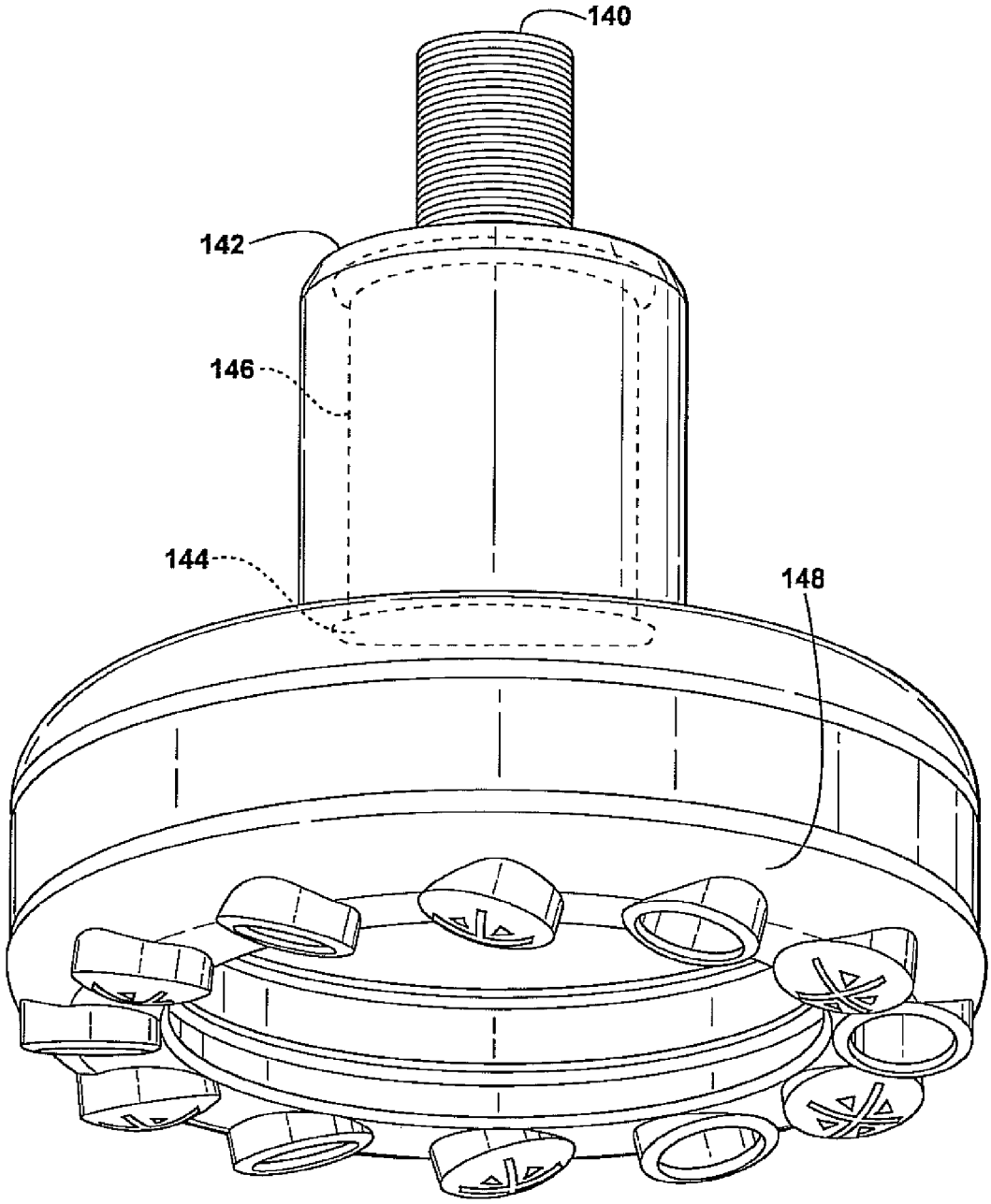
FIG. 17 is a sectional illustration of the interior components of the faucet assembly and including the stationary main shaft, inner seal and annularly disposed oil chamber, and lower rotating nozzle plate.
Figure 18:
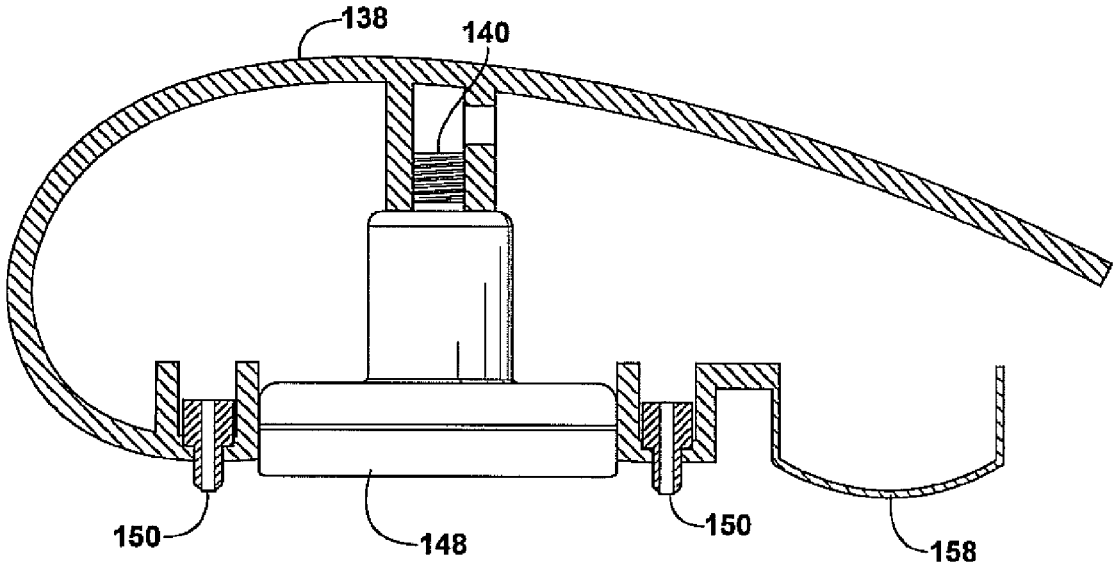
FIGS. 18 and 19 are cutaway diagrammatic views of the faucet assembly variant of FIG. 15.
Figure 19:
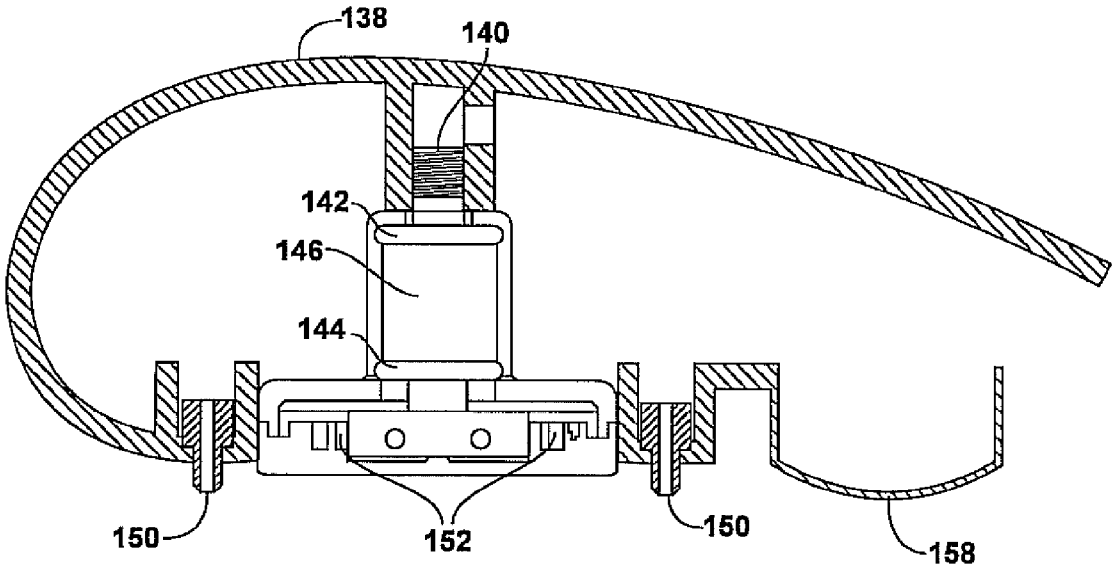

As further referenced by the sectional illustration of the interior components of the faucet assembly, namely FIG. 17, as well as the cutaway diagrammatic views of FIGS. 18 and 19, the assembly includes a configured and assembly supporting housing 138, within which is mounted a stationary and fluid delivery main shaft 140, inner seals 142 and 144 enclosing an annularly disposed oil chamber 146 (see in particular FIG. 17), and a lower rotating nozzle plate 148.

Surrounding the nozzle plate 148 are a plurality of circumferentially arrayed spray apertures, see at 150 in FIGS. 18 and 19, each of which issuing a finer or softer spray. Further incorporated into the nozzle plate 148 are a plurality (typically six) of individual and rotating water jet passageways, see further at 152. The water jet passageways each exhibit a downwardly and arcuately bent configuration and, further such as is shown in FIGS. 14 and 15, rotation of the same serves to create individual and arcuately woven fluid streams 154 issued from the rotating nozzle plate 148.

As illustrated throughout the several illustrations of FIGS. 14-19, the water jets 154 are designed for the dual purposes of cleaning tough surfaces through continuous impact of the slow rotating jets 154 while the sprays 150 generate a non-rotating spray pattern acting as a splash guard curtain. The rotation speed of the nozzle plate 148 is again inhibited by the function of the fluid dampening chamber 146 (see FIG. 19), and such that impact forces created by the arcuately woven water jets 154 are maximized.

Figure 15:
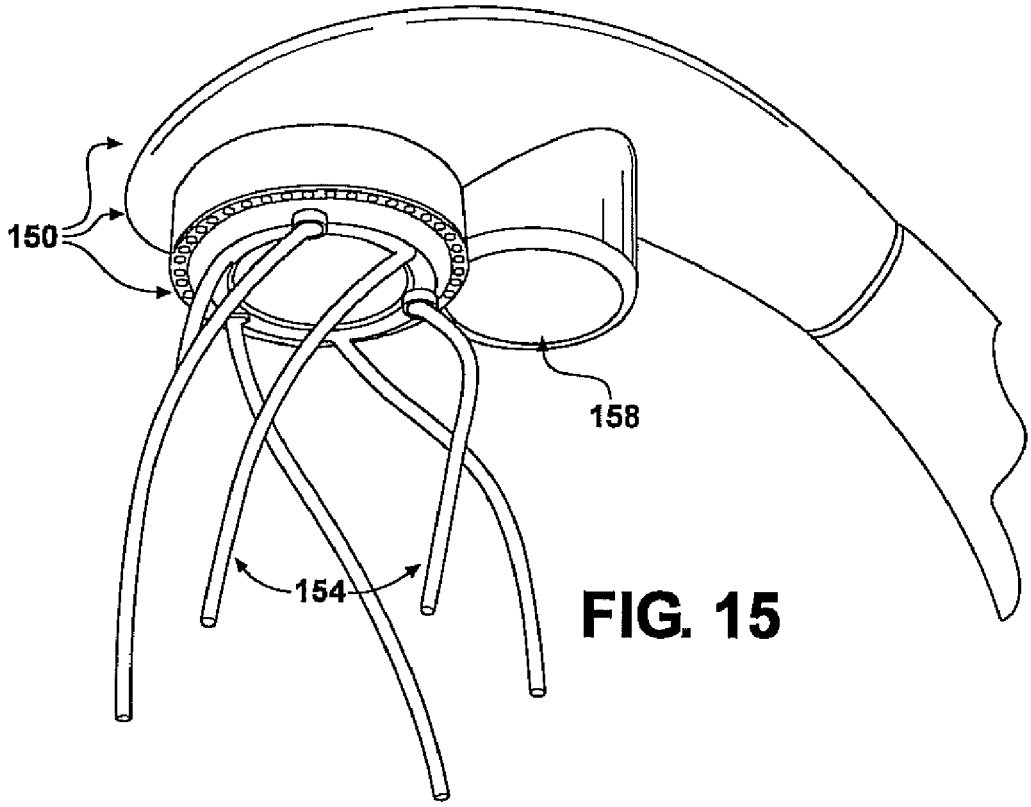
FIG. 15 is an enlarged sectional perspective of a faucet assembly according to a further variant and illustrating the feature of an aerator incorporated into the extending neck of the assembly.
Figure 16:
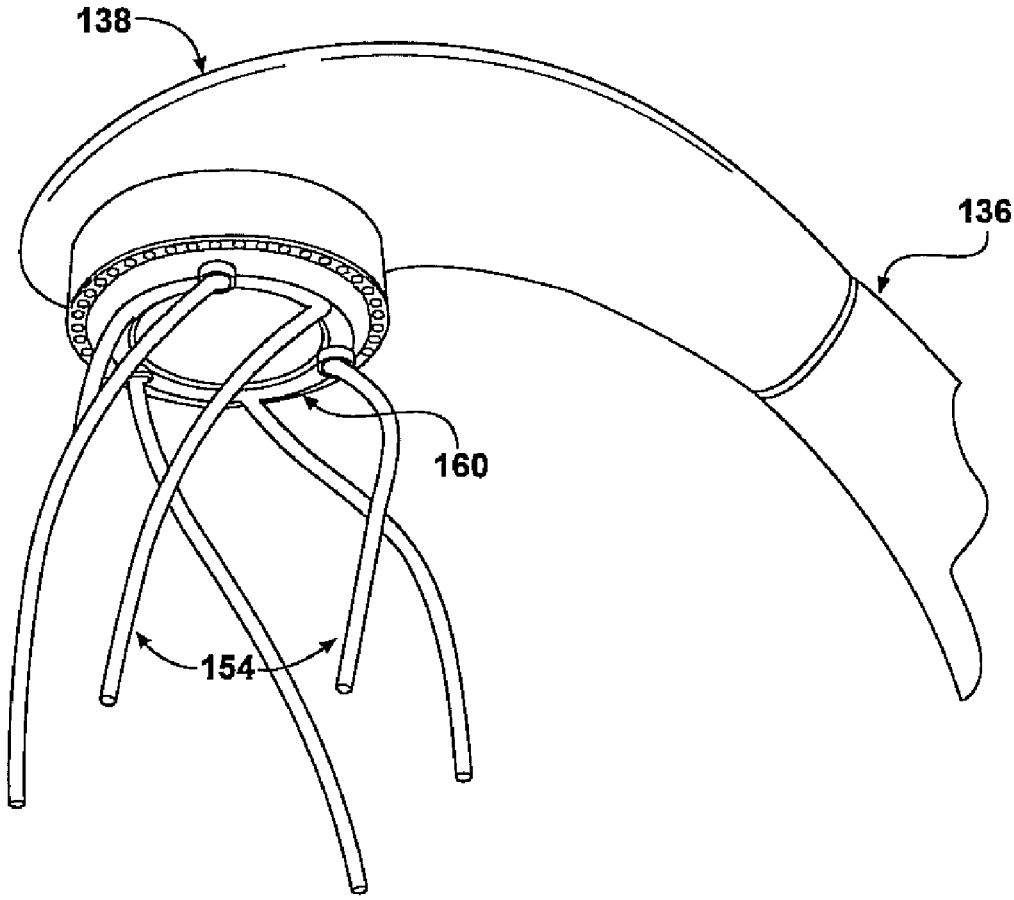
FIG. 16 is an enlarged sectional perspective of the faucet head of FIG. 14 and illustrating the feature of a centrally disposed aerator about which is disposed the rotary driven nozzle plate.

As also illustrated in the enlarged sectional perspective of the faucet assembly of FIG. 15, the feature of an aerator 158 is incorporated into the extending neck of the assembly. Another variant, see in particular FIG. 16, illustrates an aerator 160 centrally and coaxially incorporated into the faucet assembly within the rotating nozzle plate 228.

Having described my invention, other and additional preferred embodiments will become apparent to those skilled in the art to which it pertains, without deviating from the scope of the appended claims. In particular, other and additional mechanisms for reconfiguring at least one of a pulse rate, flow rate, or flow direction can be incorporated into the invention.

Additionally, other types of dampening/restricting mechanisms can be employed into the assembly for restricting the rate of rotation of the selected fluid receiving/converting components. Other and additional functional applications may also be made possible by the present invention, and outside of the use as a shower head or faucet. Such additional applications may include any desired type of fluid distribution assembly, such as contemplating vehicle fuel injection assemblies or other desired fluid converting and injection assemblies, where it is desired to modify the flow/pulse rate of a fluid prior to a given application.

I claim:

1. An assembly for regulating a fluid flow, comprising:

a stationary and fluid supplying shaft about which is supported a rotating outer component, said shaft including an inlet for receiving the fluid flow, said outer component in communication with said shaft and including an outlet for issuing a regulated fluid flow;

said rotating outer component exhibiting at least one arcuate and flow conducting surface, said rotating outer component further comprising a bottom disposed rotating nozzle plate including a plurality of individual and downwardly angled nozzles for issuing the regulated fluid flow;

a three dimensional annular and interiorly hollowed disk secured to a bottom end of said shaft in sandwiching fashion between the shaft and said rotating nozzle plate, said disk and shaft defining therebetween a water jet distribution chamber, a plurality of angled fluid jet apertures formed through an annular wall in said disk redirecting fluid introduced through said shaft to said rotating nozzle plate;

said rotating nozzle plate further comprising further comprising a plurality of circumferentially arrayed propelling blade portions surrounding said disk and redirecting/splitting the redirected fluid flow delivered through said angled fluid jet apertures, and for delivery to said individual and downwardly angled nozzles defined in said rotating nozzle plate, for issuing therefrom a plurality of fluid spray jets; and a fluid dampening element positioned between said shaft and said rotating outer component and restricting a rotational speed associated with said rotating outer component, in response to rotational forces imparted by the inlet fluid flow, and in order to modify at least one of a flow and pulse rate of the fluid.

2. The assembly as described in claim 1, said fluid dampening element further comprising an oil chamber disposed between said rotating outer component and said stationary shaft, a pair of annular seals defining upper and lower boundaries of said chamber.

3. A shower head assembly for dampening a fluid inlet flow to a regulated outlet flow, said assembly comprising:

a stationary shaft threadably engaged to a fluid supply for receiving the fluid inlet flow;

a rotating outer component secured about said stationary shaft and defining an outlet for issuing the regulated fluid flow;

an interiorly hollowed disk secured to a bottom end of said shaft and defining therebetween a water jet distribution chamber, a plurality of angled fluid jet apertures formed through an annular wall in said disk for redirecting outwardly fluid introduced through said shaft;

said rotating outer component further including a bottom disposed rotating nozzle plate within which is seated said interiorly hollowed disk, said nozzle plate incorporating an inner disposed and circumferentially directed array of rotary propelling blades upon which said redirected fluid from disk impinges to rotated said plate, said fluid being collected within an outer annular chamber of said rotating nozzle plate and prior to being communicated through a plurality of individual and downwardly angled nozzles in said nozzle plate for issuing the regulated fluid flow; and a fluid dampening element positioned between said shaft and said rotating outer component and restricting a rotational speed associated with said rotating outer component, in response to rotational forces imparted by the inlet fluid flow, and in order to modify at least one of a flow and pulse rate of the fluid.

4. The assembly as described in claim 3, said rotating outer component further comprising an annular shaped cover from which upwardly extends a collar portion surrounding the shaft, said nozzle plate assembling to a bottom of said cover.

5. The assembly as described in claim 3, said shaft further comprising an interior stem portion bounded by first and second axially spaced collars between which is supported a fluid dampening oil reservoir.

6. The assembly as described in claim 5, said shaft terminating in an enlarged annular collar to which said interiorly hollowed disk is assembled.

7. The assembly as described in claim 3, said nozzle plate and said interiorly hollowed disk each further comprising overlapping and raised projections for seating said nozzle plate against said interiorly hollowed disk and for permitting rotation of said nozzle plate thereabout.

8. The assembly as described in claim 3, further comprising said plurality of angled fluid jet apertures formed through an annular wall in said disk shaped element being defined in circumferentially offset and angled fashion.

* * * * *

UNITED STATES PATENT AND TRADEMARK OFFICE

CERTIFICATE OF CORRECTION

PATENT NO. : 7,584,906 B2
APPLICATION NO. : 11/296111
DATED : September 8, 2009
INVENTOR(S) : Mordechai Lev It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 735 days.

Signed and Sealed this

Fourteenth Day of September, 2010

David J. Kappos

David J. Kappos
*Director of the United States Patent and Trademark Office*